United States Patent [19]

Brown

[11] 4,123,981

[45] Nov. 7, 1978

[54] NEEDLE FEED ON ELECTRONIC SEWING MACHINE

[75] Inventor: Jack Brown, Union, N.J.

[73] Assignee: The Singer Company, New York, N.Y.

[21] Appl. No.: 858,497

[22] Filed: Dec. 8, 1977

[51] Int. Cl.[2] ..... D05B 3/02; D05B 27/20

[52] U.S. Cl. ..... 112/158 E; 112/213

[58] Field of Search ..... 112/158 E, 158 R, 206, 112/213

[56] References Cited

U.S. PATENT DOCUMENTS

| | | | |
|---|---|---|---|
| 3,094,087 | 6/1963 | Thorne | 112/206 |
| 3,561,382 | 2/1971 | Ketterer et al. | 112/158 R X |
| 4,016,821 | 4/1977 | Minalga | 112/158 E |

*Primary Examiner*—Peter Nerbun

*Attorney, Agent, or Firm*—Robert E. Smith; Edward L. Bell; Edward P. Schmidt

[57] ABSTRACT

An electronically controlled sewing machine which, in addition to the capability to stitch in the longitudinal direction, may selectively feed a work material in a selected right or left lateral direction. Additionally, bight pattern information may be taken from a memory means of the sewing machine and applied to the feed system thereof in order to obtain lateral patterning. In order to obtain lateral feeding, a straight stitch pattern is selected from the memory means in order to provide null or zero bight signal indicative of center needle position. Simultaneously, the signal from the arm shaft position sensor is applied to the bight actuating circuit, this arrangement providing for motion of a sewing needle in one lateral direction while in a work material, and in the other lateral direction while out of a work material. By applying the signal from the arm shaft position sensor to a selected inverting or non-inverting terminal of an operational amplifier in the bight actuating circuit, a selected right or left lateral feed direction may be obtained. In order to obtain lateral patterning, the signal from the arm shaft position sensor is directly applied to the selected terminal of the operational amplifier in the bight actuating circuit. Concurrently, the bight pattern information released from the memory means is transferred to the feed actuating circuit.

10 Claims, 9 Drawing Figures

NEEDLE FEED ON ELECTRONIC SEWING MACHINE

BACKGROUND OF THE INVENTION

The invention relates to electronically controlled sewing machines, and more particularly, to a means for readily and quickly obtaining from such a sewing machine a lateral feeding and patterning capability that will permit the machine so modified to feed in a longitudinal direction, as is usual in sewing machines, and, selectively, in a lateral direction in the formation of lateral stitches, or of lateral patterns.

It is known in the prior art, to provide for sewing machines having lateral feeding capability. There is, for example, in the Japanese Patent Publication No. 27028/65, applied for Dec. 24, 1963, a disclosure of a mechanical sewing machine wherein the fabric may be fed laterally by a lateral motion of the sewing needle while in a work material, to produce, for example, a random pattern having an extra wide bight. There is also shown in U.S. Pat. No. 3,561,382 of Ketterer et al, a sewing machine having a removable cam mechanism which influences motion of the needle bar and needle attached thereto while in the work material, thereby to effect lateral shift thereof. The above two prior art devices disclose sewing machines in which mechanical means are provided to enable lateral shift of work material, the United States Patent disclosing a means whereby this may be incorporated into a family type of sewing machine.

There is also a body of prior art in the class of sewing machine known as needle feed machines. This prior art relates to a particular type of industrial sewing machine which normally includes a needle bar mechanism oscillatable in the line of feed while undergoing endwise reciprocation. Normally, an industrial sewing machine having a needle feed is dedicated to this particular type of operation without the potential for conversion to any other type of operation.

In the recent past, there have been made available sewing machines wherein the sewing instrumentalities are manipulated by electrical means under the control of electronic circuitry. In these types of machines, for example, a needle bar may be shifted by means of a stepper motor or a linear motor, which receives its directions from a magnetic tape or a solid state memory. The position of a feed regulator or sewing machine work clamp may be similarly achieved and determined. What is required is a means for obtaining lateral feeding of a work material in these electronically controlled sewing machines. It would be further desirable, that these machines incorporate the capability for lateral patterning in addition to the longitudinal patterning capability inherent in these machines.

SUMMARY OF THE INVENTION

One of the aforementioned requirements for an electronically controlled zig zag sewing machine is attained in such a machine wherein electrical switch means are provided to nullify a feed position signal and simultaneously provide a bight position signal effective to actuate a linear motor or stepper motor while a sewing needle is in a work material. The sewing machine may be placed into a mode of operation such as straight stitch mode, which results in no bight position signal being supplied by a memory device to a needle bar gate actuating means such as a linear motor. In the embodiment disclosed, an effective source for a signal, to obtain needle feed while in a work material and needle return to a starting position when removed from a work material, is found in an arm shaft position sensor normally used in machines of this type to trigger the release of information from a memory means implemented by magnetic tape or solid state device. The arm shaft position sensor operates to deliver a voltage of one polarity with the sewing needle in the down position, and a voltage of the opposite polarity with the sewing needle in the up position. The output of the arm shaft position sensor, when applied as a bight positional signal, will be effective to cause motion of the sewing needle in one lateral direction with the needle up, and in the opposite lateral direction with the needle down in the work material. The electronic controls of the sewing machine thus arranged may be made effective to influence lateral shift of a work material by needle feed, while inhibiting longitudinal feed of the work material by the feeding means of the sewing machine. Lateral feeding of a work material is further enhanced by reducing the pressure on a presser bar of the sewing machine in order to avoid tearing or buckling of a light work material or deflection of a sewing needle effecting needle feed. While the sewing needle is in the work material, a loop of needle thread is picked up by a looptaker for concatenation with a lower or bobbin thread in a manner well known in the sewing machine art. The bight positional signal provided by the arm shaft position sensor may be provided to the positioning means, such as a linear actuator, through the inputs of an operational amplifier. Thus, the direction of lateral motion may be determined by connection of the output of the arm shaft position sensor to the inverting or to the noninverting terminal of such an operational amplifier.

A further of the aforementioned requirements for electronically controlled zig zag sewing machine is attained in such an electronically controlled sewing machine, where the bight positional information from a memory means, such as a magnetic tape or solid state device, may be transferred to be used as feed positional information. A five gang switch is used, which has three positions for left lateral feed, right lateral feed or normal sewing. The first switch circuit is used to insert an inverter between the arm shaft position sensor and the memory device during left or right lateral feed, in order to effect the release of bight positional information from the memory for use during the feed portion of the sewing cycle. A second switch circuit is used to transfer the bight positional information derived from the arm shaft position sensor to the inverting or non-inverting terminal of the operational amplifer in the bight actuating curcuit for a selected direction of feed. A third switch circuit is used to transfer bight positional information released from the memory to the feed actuator curcuitry. The fourth and fifth switch circuits are used to nullify signals other than the desired bight and feed signals, respectively, from the bight and feed actuating circuits. Thus, in the lateral feed mode, the bight positional signal derived from the arm shaft position sensor is transferred to the proper terminal of the operational amplifier in the bight actuating circuit for the selected lateral direction of feed. The inverted signal from the arm shaft position sensor releases bight positional information from the memory during the feed portion of the sewing cycle, which information is transferred to the feed actuating circuitry. For certain bight patterns, the result is a lateral patterning substantially at right angles to the normal longitudinal direction of feed.

Lateral feeding is facilitated by the use of an even feed foot which is supported by the sewing machine presser bar and driven by the needle bar. This foot operates to clamp the work material during needle penetration and removal, but leaves the work material free for lateral movement after penetration by the needle. In this way lateral feeding on the lightest work material, which requires support during needle penetration or removal, may be accommodated.

A further understanding of the invention and the manner in which it may be implemented may be had by reference to the accompanying drawings in which.

Figure 1:
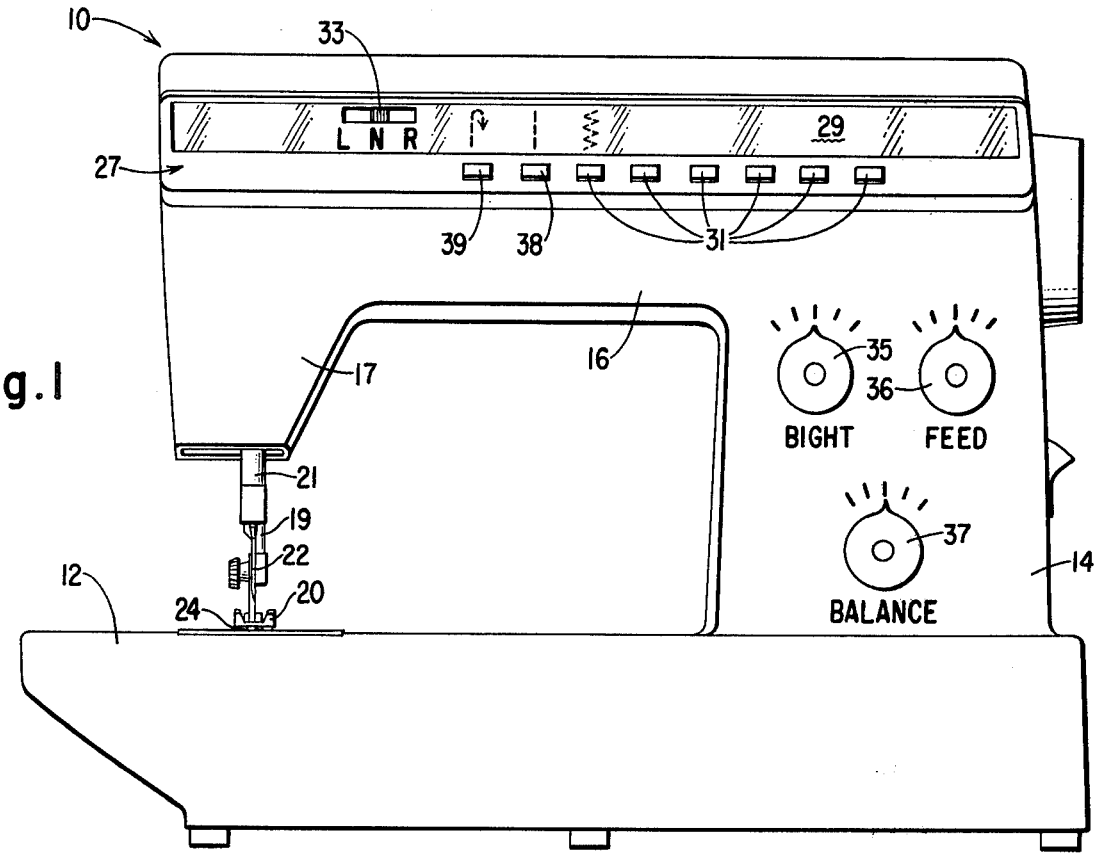
FIG. 1 is a front elevational view of a sewing machine in which the invention may be incorporated.

Referring to FIG. 1, there is shown an electronically controlled sewing machine 10 to which the invention has been applied. The sewing machine 10 is fashioned with a bed portion 12 having a standard 14 supported at one end thereof, the standard carrying an arm portion 16 overhanging the bed portion and terminating in a head 17. Within the head 17 there is supported a presser bar 19 and a needle bar 21. The needle bar 21 terminates in a sewing needle 22, the assembly of the needle bar and sewing needle being adapted to undergo endwise reciprocation in a manner well known in the sewing machine art, that the sewing needle may cooperate with sewing instrumentalities (not shown) located in the bed portion 12 in the formation of stitches. Other equally well known mechanism is provided in the sewing head 17 which will accommodate the lateral shift of the sewing needle 22 in the formation of ornamental patterns. The presser bar 19 terminates in a presser foot 20 which is adjustably urged by well known instrumentalities (not shown) in the sewing head 17 against a feed dog 24 normally adapted by well known mechanism (not shown) within the bed 12 to urge the sewing machine to feed a work material in a longitudinal direction when the sewing needle 22 is withdrawn from the work material inserted between the presser foot 20 and feeding dog 24. The presser foot 20 may be of a variety adapted to accommodate the lateral shift of the sewing needle 22 with a minimum impeding effect on lateral motion of a work material, similar to that disclosed in the U.S. Pat. No. 3,561,382 of Ketterer et al, which is assigned to the same assignee as the instant invention, and is hereby incorporated by reference herein. Alternatively, it has been found beneficial to use an even feeding attachment as disclosed in the U.S. Pat. No. 3,730,117 of Ritter et al, which is assigned to the same assignee as the instant invention, and is hereby incorporated by reference herein. The beneficial effects which flow from the use of the even feeding attachment will be described below.

There is provided in the arm portion 16 a front panel 27. In this front panel 27 there is a pattern and sewing mode display 29, several pattern selector buttons 31, and a needle feed button 33 whose operation will be explained below. In the standard 14 of the sewing machine 10 there is shown a bight control knob 35, a feed control knob 36, and a balance control knob 37, for regulating bight width, feed length, and forward to reverse feed balance for patterns having a feed component, respectively. A straight stitch selector button 38 is provided, as well as a reverse stitch selector button 39 which is effective to obtain straight stitch reverse sewing whenever depressed regardless of which selector buttons 31 or 38 was depressed. A fuller understanding of the operation of an electronically controlled sewing machine in general and of the reverse stitch operation may be had by reference to the U.S. Pat. No. 3,977,338 of Wurst et al, which is assigned to the same assignee as the instant invention, and is hereby incorporated by reference herein.

Figure 2:
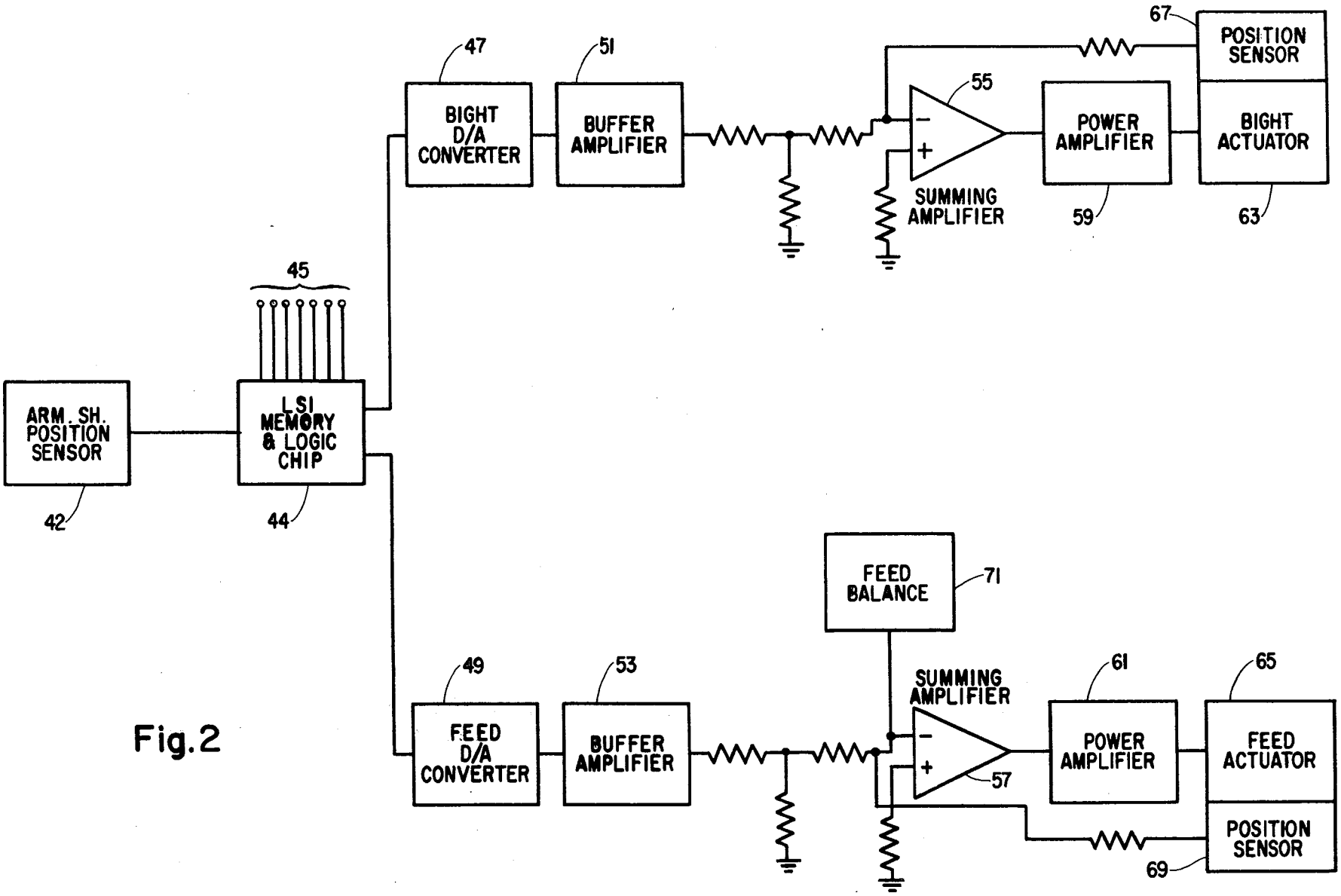
FIG. 2 is a simplified block diagram of an electronically controlled zig zag sewing machine to which the invention may be applied.

Referring to FIG. 2 there is shown a simplified block diagram of an electronically controlled zig zag sewing machine to which the invention may be applied. A more complete exposition of an electronically controlled sewing machine may be had by reference to the U.S. Pat Nos. 3,855,956 and 4,016,821, assigned to the same assignee as the instant invention, which are hereby incorporated by reference herein. Thus, the arm shaft position sensor 42 of FIG. 2 constitutes a pulse generator having a component thereof supported on a horizontal arm shaft of a sewing machine to provide a pulse, with each needle reciprocation, to the large scale integration memory and logic chip (LSI) 44. The pulse generator may be a modification of the device described in the U.S. Pat. No. 3,939,372, assigned to the same assignee as the instant invention, which is hereby incorporated by reference herein. The necessary modification will be described below. The LSI memory and logic chip 44 has as inputs 45 thereto selections made by way of pattern selector buttons 31, straight stitch button 38 or reverse button 39. Additional information on a pattern selection system for an electronic sewing machine may be obtained from the U.S. Pat. No. 3,913,506, assigned to the same assignee as the instant invention, which is hereby incorporated by reference herein. The timing pulses produced by the arm shaft position sensor 42 between each successive stitch causes the LSI memory and logic chip 44 to release digital pattern information at the proper time to a bight digital to analog converter 47, to cause the sewing needle 22 to undergo lateral oscillation when out of the work material held beneath the presser foot 20; and to the feed digital to analog converter 49 when the sewing needle is in the work material to permit feeding of the work material when the sewing needle 22 is withdrawn therefrom. The output analog signal from the digital to analog converters 47, 49 are transferred to buffer amplifiers 51, 53 for bight and feed, respectively. The buffer amplifiers 51, 53 include operational amplifiers having gain control feedback circuits, including rheostats manipulated by the bight knob 35 and the feed knob 36, for regulation of the bight width and of the feed length, respectively. The regulated bight analog information is transferred from the buffer amplifier 51 to the inverting terminal of summing amplifier 55. The bight information undergoes further amplification in the power amplifier 59 and is then utilized to position a bight actuator 63. Position sensor 67 associated with the bight actuator 63, provides a feedback position signal, indicative of the existing position of the bight actuator 63, which is returned to the summing amplifier 55 as an error signal. The regulated feed analog information follows a similar path from the buffer amplifier 53 to inverting terminal of the summing amplifier 57, and from there to the power amplifier 61, where the signal is amplified to position feed actuator 65. An error signal is provided by position sensor 69, associated with the feed actuator 65, which is returned to feed summing amplifier 57. The feed summing amplifier 57 has as input thereto in addition to the regulated analog signal from the buffer amplifier 53, the wiper of a feed balance potentiometer 71 which is connected as a voltage divider to a double ended reference voltage output of a voltage regulator in the power supply. The feed balance potentiometer 71 is preferably connected as shown in the U.S. Pat. No. 3,984,745 of Oct. 5, 1976, to be effective to correct both forward and reverse feed. For the sake of simplicity, the feed balance potentiometer 71 is omitted from FIGS. 4 and 5, but would normally be included therein.

Thus, the arm shaft position sensor 42 triggers the release of digital pattern information from the LSI memory and logic chip 44, according to the input 45 selected, the digital information being converted to analog form to undergo regulation and amplification prior to transfer to a servo system driving, for example, linear motors used as actuators. The digital information obtained from the LSI memory and logic chip 44 is thereby used to position a needle bar gate of a sewing machine to determine lateral position of the sewing needle, and to determine the position of a feed regulator of a sewing machine to establish rate and direction of feed. The arm shaft position sensor 42 may be implemented by a Hall effect device as taught in the U.S. Pat. No. 3,939,372 referred to above, somewhat modified to obtain compatibility with the specific LSI memory and logic chip 44 used. Thus, the Hall effect device used may have an output of plus 7.5 volts or minus 7.5 volts depending upon the state of the device. As the sewing needle 22 of the sewing machine 10 is removed from a work material, the Hall effect device may output a plus 7.5 volts, and indicate to the LSI memory and logic chip 44 that bight information may be released from the LSI to the bight conversion, amplification and servo circuitry. Therefore, as the sewing needle 22 is removed from the fabric, the bight actuator 63 becomes effective to reposition the needle according to information released from the LSI 44. The arm shaft position sensor 42 may be arranged to output a minus 7.5 volt signal when the sewing needle 22 is in a work material, thereby to provide a signal to the LSI memory and logic chip 44 to release feed digital information to the feed digital to analog converter 49 and the remaining circuitry in order to cause the feed actuator 65 to position the sewing machine feed regulator while the feed dog 24 is undergoing a return motion to begin a new feeding cycle.

Figure 3:
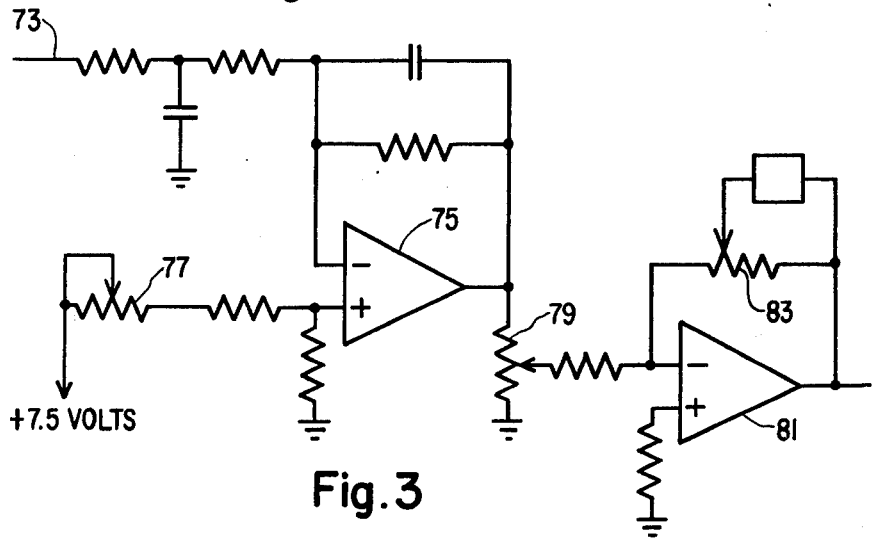
FIG. 3 is a detailed circuit diagram of the D/A converters shown in FIG. 2.

In FIG. 3 there is shown a detailed circuit diagram of the digital to analog converters 47, 49 which include a portion of the buffer amplifiers 51, 53. The circuit shown is similar for bight or for feed. The LSI memory and logic chip 44 releases digital information to the converters 47, 49 in a pulse width modulated signal. The pulse width modulated signal from the LSI memory and logic chip 44 is transferred to the D/A converters 47, 49 by way of line 73. The pulse width modulated signal undergoes filtration prior to input to the inverting terminal of operational amplifier 75. The pulse width modulated signal is offset to give a plus component as well as a minus component by means of a plus 7.5 reference voltage applied to the non-inverting terminal of operational amplifier 75 through a trimpot 77. The output from the operational amplifier 75 is scaled by rheostat 79 prior to transfer to the inverting terminal of operational amplifier 81, part of buffer amplifiers 51 or 53. It will be noted that the bypass resistor 83 of the operational amplifier 81 is provided with means to vary the resistance in bypass arrangement thereby to vary the gain of the operational amplifier 81 in order to vary bight width or stitch length. Further particulars on this arrangement may be had by referring to the above referenced U.S. Pat. No. 4,016,821. Thus, the pulse width modulated digital signal, from the LSI memory and logic chip 44, is converted to an analog signal having a range of voltages on both sides of zero corresponding to a range of positions of the sewing needle 22 and the feed regulator on both sides of a center, or null position, respectively.

Figure 4:
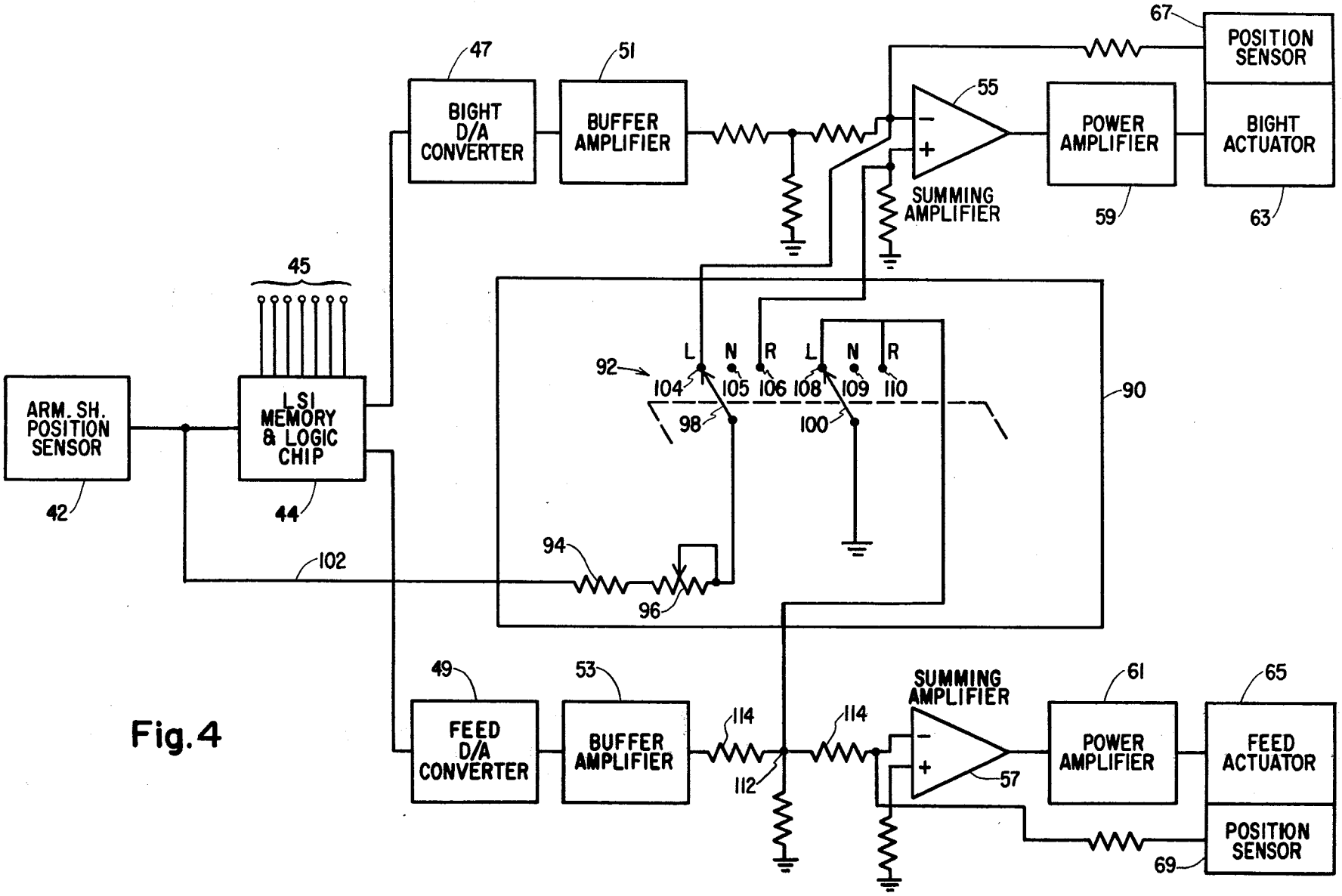
FIG. 4 is a simplified block diagram of an electronically controlled zig zag sewing machine as shown in FIG. 2 with the addition of those components permitting lateral feeding.

In FIG. 4 is shown a block diagram of a sewing machine as shown in FIG. 2 with modifications thereto to permit the lateral feeding of work material. The block diagram of FIG. 4 is modified by the addition of a block 90 having four points of connection to the block diagram as shown in FIG. 2. The block 90 includes a two gang, three position switch 92, a stitch length limit resistor 94 and a stitch control variable resistor 96. The three positions of the two gang switch 92 are labeled L, N and R, referring to left lateral feed, normal longitudinal feed and right lateral feed. The wiper 98 of the first switch of the two gang switch 92 is connected to one end, and the wiper, of the stitch length control variable resistor 96, which has its other end connected to the stitch length limit resistor 94. The opposite end of the stitch length limit resistor 94 is connected by line 102 to the output of arm shaft position sensor 42, without disturbing the connection thereof to the LSI memory and logic chip 44. The L terminal 104 of the first switch of the two gang switch 92 is connected to the inverting terminal of the bight summing amplifier 55. The R terminal 106 of the first gang of the two gang switch 92 is connected to the non-inverting terminal of the bight summing amplifier 55. The wiper 100 of the second switch of the two gang switch 92 is grounded. The L terminal 108 and the R terminal 110 of the second switch of the two gang switch 92 are connected together, and to the point 112 in the feed signal line between the feed buffer amplifier 53 and the feed summing amplifier 57, and isolated from these amplifiers by isolating resistors 114. The two gang, three position switch 92 is manipulated to the L, N or R position by means of the needle feed button 33 protruding from the display 29 of the sewing machine 10 (see FIG. 1), in order to permit an operator to select the mode of operation of the machine. In FIG. 1 the needle feed button 33 is shown in the N position in which the machine operates as a normal sewing machine having forward or reverse feed, or longitudinal patterning capabilities.

The operation of the sewing machine modified as shown in FIG. 4 and described above will now be explained. With the needle feed button 33 shown in FIG. 1 in the N position, the wipers 98, 100 of the two gang switch 92 are in the N 105, 109, positions, where they are ineffective to modify the normal operation of the sewing machine. If the straight stitch selector button 38 is selected and the needle feed button 33 shown in FIG. 1 is moved to the L position, the wipers 98, 100 are in the position shown in FIG. 4. The wiper 100 of the second switch of the two gang switch 92 is connected to ground, and is connected to the analog output of the feed buffer amplifier 53, thereby short circuiting the output between the feed buffer amplifier and the feed summing amplifier 57, providing a zero voltage reference for the feed servo system, which will move the feed regulator of the sewing machine 10 to a null position where no forward or reverse motion is imparted to the work material. The wiper 98 of the first switch of the two gang switch 92 establishes a connection between the inverting input terminal of the bight summing amplifier 55 and arm shaft position sensor 42 by way of stitch length limit resistor 94 and stitch length control resistor 96. Thus, the output of the arm shaft position sensor 42 is applied as an attenuated signal to the inverting terminal of bight summing amplifier 55. Since the straight stitch selector button 38 has been selected the LSI memory and logic chip 44 will output a zero voltage signal corresponding to center needle position. The 7.5 volt output from the arm shaft position sensor 42 is dropped by the stitch length limit resistor 94, and the trimpot used as the stitch length control variable resistor 96 provides the fine control required to accommodate the output of the arm shaft position sensor to the bight actuator 63. As explained above, when the sewing needle 22 is out of a work material, the output of the arm shaft position sensor 42 is a positive voltage, to which the bight actuator 63 responds with a movement of the sewing needle 22 to the right. When the sewing needle 22 is in a work material, the output of the arm shaft position sensor 42 is a negative voltage which causes the bight actuator 63 to move the sewing needle 22, while extending through the work material, in a leftward direction. In order to accommodate a lateral shift of the work material, the presser foot 20 may be of a design disclosed in the above referenced U.S. Pat. No. 3,561,382 and the pressure regulating mechanism for the presser bar 19 and presser foot 20 may be set to the darning position, for minimum pressure, as is well known in the sewing machine art.

When the straight stitch selector button 38 is selected and the needle feed button 33 is shifted by an operator to the R position, the wiper 100 of the second switch of the two gang switch 92 still short circuits the output of the feed buffer amplifier 53 to ground, and the wiper 98 of the first switch of the two gang switch 92 connects the output of the arm shaft position sensor 42 to the non-inverting terminal of the bight summing amplifier 55. This new connection to the noninverting terminal of the bight summing amplifier 55 reverses the previously explained operation of the bight actuator 63. Thus, as the arm shaft position sensor 42 responds with a positive voltage to the withdrawal of the sewing needle 22 from a working material, this voltage is acted on by the bight summing amplifier 55 and the bight actuator 63 to cause the sewing needle to move to the left. When the arm shaft position sensor 42 responds to the insertion of the sewing needle 22 in a work material with a negative voltage, the negative voltage is acted on by the bight summing amplifier 55 and the bight actuator 63 causing the sewing needle 22 to move to the right while the sewing needle is in a work material, carrying the work material in a rightwardly direction.

Thus has been disclosed an electronically controlled sewing machine, as known in the prior art, which may include, by the addition of relatively few parts, the capability for lateral feeding. The lateral feeding is accomplished by repositioning the sewing needle 22 while the sewing needle is inserted in the work material, utilizing the output of the arm shaft position sensor 42 to obtain a lateral needle feed and return motion of the sewing needle, while the bight output from the LSI memory and logic chip 44 is nullified by selecting the straight stitch selector button, thereby to obtain 0 voltage output. In order to accommodate lateral feeding, the feed signal from the LSI 44 is short circuited to ground in order to obtain a zero voltage feed signal. In certain cases shifting of the sewing needle 22 from one position to another position, may generate a feed component causing the material to shift a small amount. This may be nullified by manipulating the balance control knob 37 connected to the feed balance potentiometer 71 shown in FIG. 2 and described above, which is connected to the inverting terminal of the feed summing amplifier 57. The potentiometer 71 so connected may be utilized to nullify any feed component from positioning of the sewing needle 22 by applying a suitable voltage to the feed actuator 65 in opposition to such a feed component.

Figure 5:
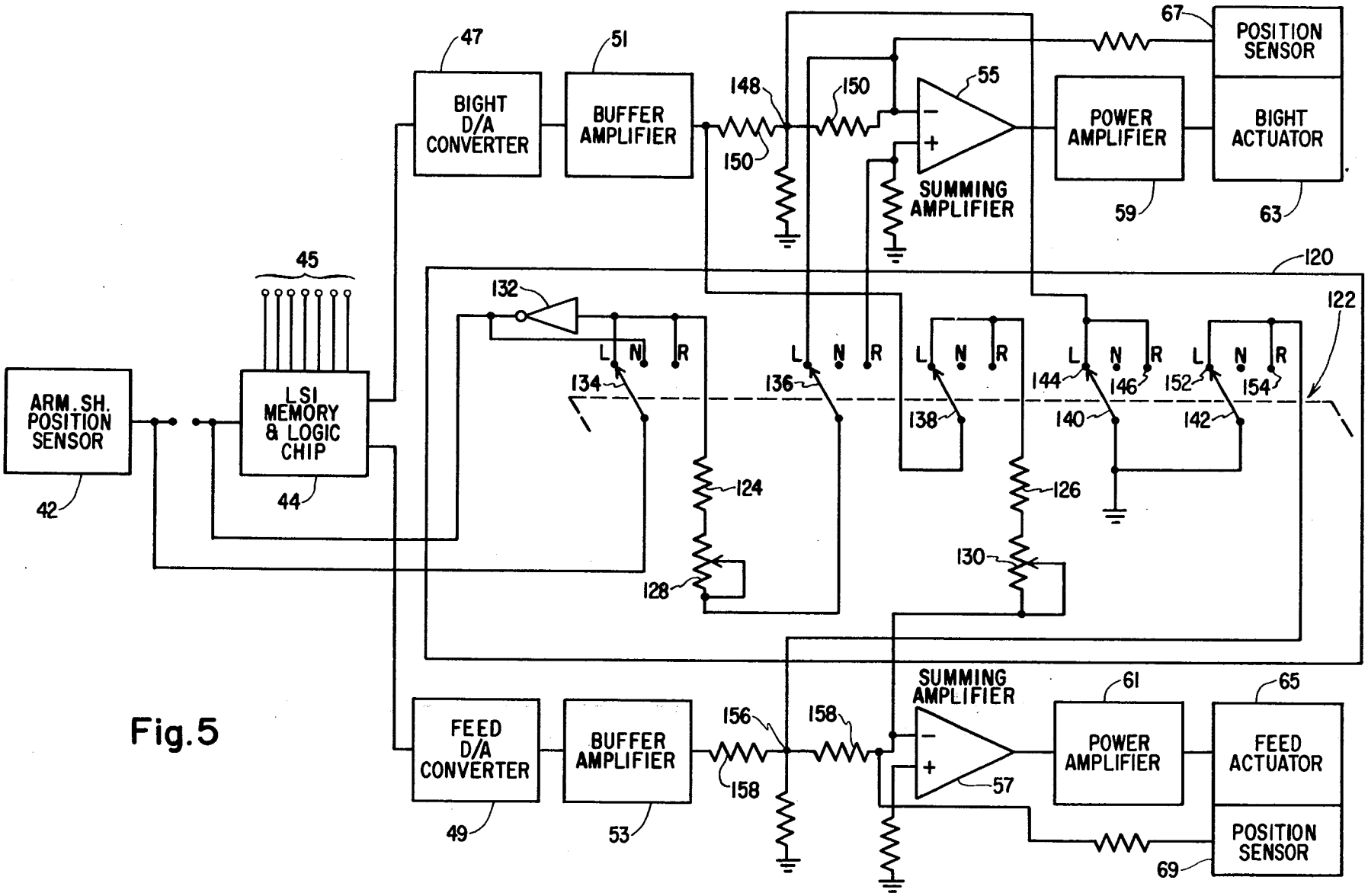
FIG. 5 is a simplified block diagram of an electronically controlled zig zag sewing machine as shown in FIG. 2 with the addition of those electronic components permitting lateral feed and lateral patterning.

A further improvement may be obtained in an electronically controlled sewing machine where, in addition to the lateral feed capability described above, the sewing machine is also capable of lateral patterning. In FIG. 5 there is shown a simplified block diagram of an electronically controlled zig zag sewing machine as shown in FIG. 2, which is modified by the addition of block 120, and connections therefrom, to obtain lateral feed and lateral patterning capability. The block 120 includes a five gang, three position switch 122, two limit resistors 124, 126, two variable control limit resistors 128, 130 and an inverter 132. The five gang switch 122 is manipulatable by the needle feed button 33 to L, N or R positions, corresponding to the left feed position, normal sewing machine operating position, or right feed position. The first switch of the five gang switch 122 is inserted in the circuit between the arm shaft position sensor 42 and the LSI memory and logic chip 44. When the wiper 134 of the five gang switch 122 is connected with the N terminal of the first switch, the signal from the arm shaft position sensor 42 is transferred directly to the LSI memory and logic chip 44, and the sewing machine 10 operates in the normal feeding and stitch patterning mode. Where, however, the wiper 134 is connected to the L terminal of the first switch of the five gang switch 122, the signal from the arm shaft position sensor 42 is first passed through an inverter 132 before being transferred to the LSI memory and logic chip 44, thus obtaining a signal of opposite polarity than that put out by the arm shaft position sensor, thereby reversing the timing of information release from the LSI. In addition to transferring the signal from the arm shaft position sensor 42 to the inverter 132, the wiper 134 of the first switch of the five gang switch 122 transfers the signal to the inverting terminal of the bight summing amplifier 55 through the stitch length limit resistor 124 in series with the stitch length variable control limit resistor 128 and through a wiper 136 of the second switch of the five gang switch 122. Concurrently, the output from the bight buffer amplifier 51 is transferred by a wiper 138 of the third switch of the five gang switch 122 to the inverting terminal of the feed summing amplifier 57 through the stitch width limit resistor 126 and the stitch width limit control resistor 130 in series therewith. As explained above with reference to FIG. 4 of the drawings, the limit resistors 124, 126 and variable control limit resistors 128, 130 are used to accommodate the new signal sources to their specific actuators 63, 65. The wiper 140 of the fourth switch of the five gang switch 122 is connected to ground, and when connected to the terminal 144 or the terminal 146, the L position and the R position, respectively, of the five gang switch 122, short circuits to ground the signal from the bight buffer amplifier 51 at terminal 148, which is situated between isolation resistors 150. The wiper 142 of the fifth switch of the five gang switch 122 is also connected to ground, and when connected to the terminals 152, 154, the L terminal and the R terminal, respectively, the signal from the feed buffer amplifier 53 is short circuited to ground at terminal 156, which is situated between isolation resistors 158. The N terminal of the second, third, fourth and fifth switch of the five gang switch 122 are open circuits to provide for normal operation of the sewing machine in normal straight stitch or pattern sewing modes, when the needle feed button 33 is positioned as shown in FIG. 1.

Thus, when the needle feed button 33 is in the L or R position the output from the arm shaft position sensor 42 is inverted in the inverter 132 and applied to the LSI memory and logic chip 44 to cause the LSI to output bight information during that portion of a stitching cycle when it would normally output feed information. Concurrently, the output from the arm shaft position sensor 42 is transferred, via the wiper 134 and the wiper 136 of the first and second switch of the five gang switch 122, to a selected terminal of the bight summing amplifier 55, thereby to cause motion of the sewing needle in a selected lateral direction while in a work material, and return to the original position when out of a work material, under the influence of the output of the arm shaft position sensor. Concurrently, the bight information released from the LSI memory and logic chip 44, is taken after amplification by the bight buffer amplifier 51 and transferred via the wiper 138 to the inverting terminal of the feed summing amplifier 57, thereby to obtain a sewing machine feed related to the bight information in the LSI. The wiper 140 and 142 of the five gang switch 122 are connected to ground, and to suitable points in the bight circuit and feed circuit, respectively, in order to nullify any undesired signals in this mode of operation. The nullification connection in the bight circuit is made between isolation resistors 150 to insure a minimal effect on the signal taken from the bight buffer amplifier 51 and on the signal applied to the bight summing amplifier 55. A similar accommodation is made by the isolation resistors 158 in the feed amplification circuit to insure a minimal effect on the signal applied to the inverting terminal of the feed summing amplifier 57. Thus, the circuit disclosed in FIG. 5 utilizes the output from the arm shaft position sensor 42 to position the work material in a selected direction laterally of normal feed, rearranges the timing of information released from the LSI memory and logic chip 44 by use of an inverter 132 to obtain release of bight information therefrom during the period of feed information utilization, and applies this bight information derived from the LSI to the feed servo amplifier system in order to obtain forward and reverse longitudinal feeding related to the bight needle positional information.

It is apparent that if the straight stitch selector button 38 is selected, instead of a pattern selector button 31, a zero or null signal will be transferred to the inverting terminal of the feed summing smplifier 57. Thus, a lateral straight stitch will be performed by the sewing machine 10, in a direction depending upon the selection of the L or R position of the needle feed button 33 protruding from the front panel 27.

Figure 7:
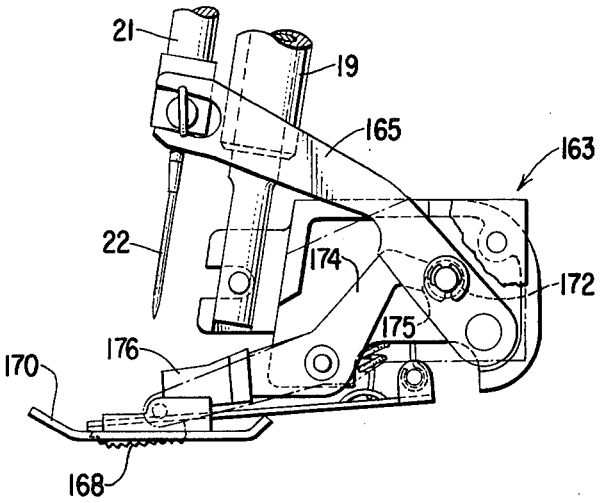
FIG. 7 is a right side elevational view of the even feeding attachment applied to the sewing machine of FIG. 1.
Figure 8:
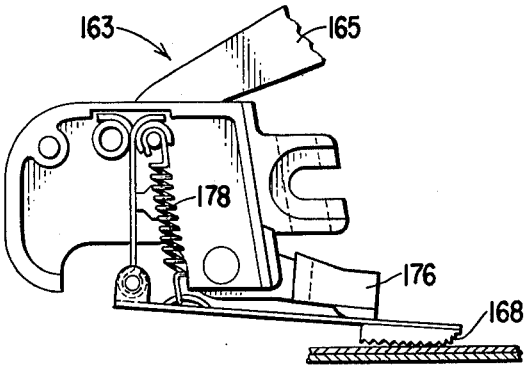
FIG. 8 is a left side elevational view of the attachment of FIG. 7.
Figure 9:
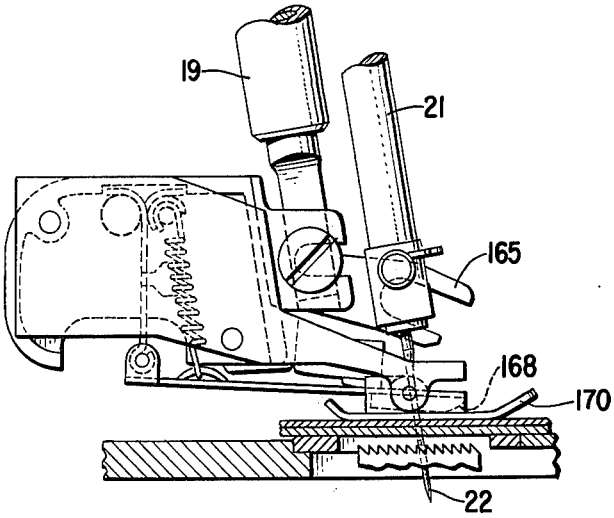
FIG. 9 is a left side elevation view of the complete attachment shown with the sewing machine presser bar and with the needle bar at the bottom of its stroke.

As was explained above, an even feed attachment described in the U.S. Pat. No. 3,730,117 incorporated by reference herein, may be substituted for the presser foot 20. As disclosed in the referenced patent, and in FIGS. 7 to 9, the even feeding attachment 163 is supported by a presser bar 19, and has a lever 165 thereof in driven engagement with the needle bar 21. The even feed attachment is supported by the presser bar set at a darn setting in order to obtain the lowest possible force on the presser foot 170 to permit easy lateral movement (see FIGS. 7 and 9). The lever 165 of the even feeding attachment actuated by the needle bar 21 manipulates an upper feeding foot 168 pivotally carried by the attachment into engagement with a work material while the needle bar is elevated and during the periods of penetration and withdrawal of the sewing needle 22 from the work material (see FIG. 7). The lever 165 carries a roller 172 in engagement with a cam end 175 of a bell crank 174 pivotably carried by the attachment 163. With the lever 165 in the position shown in FIG. 7, the enlarged head 176 on the other end of the bell crank 174 pushes down the upper feeding foot 168 in opposition to the urgings of the extension spring 178. The upper feeding foot 168 thereby extends beneath the presser foot 170, increasing the force exerted by the presser bar on the work material and providing support therefor during needle penetration. Thereafter, as the needle bar 21 continues its descent, the pressure exerted by the upper feeding foot 168 decreases rapidly as the roller 172 comes off of a raised portion of the cam end 175, to permit easy lateral feeding without work material buckling (see FIG. 9). After the sewing needle 22 has reached its lowest position and begun an upward movement, the driven element of the even feeding attachment again begins to position the upper feeding foot against a work material, for support thereof while the sewing needle is being removed therefrom. In this fashion, lighter work materials obtain the support necessary during penetration and retraction of the sewing needle 22 to obviate poor loop formation, but release this force during the critical period of lateral needle feed to avoid buckling of these light weight fabrics.

Figure 6:
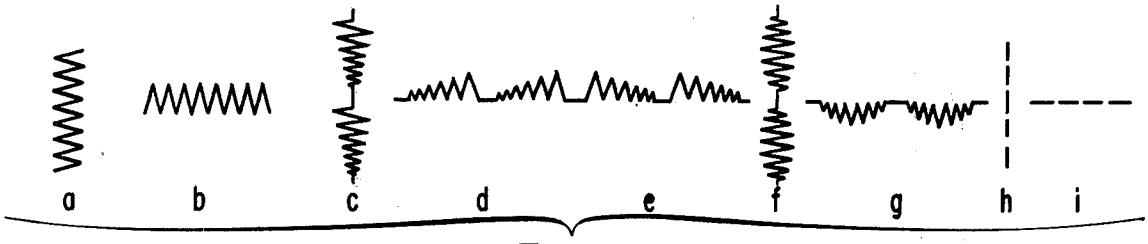
FIG. 6 is a representation of certain patterns indicating the normal longitudinal pattern and the corresponding lateral feed pattern flowing therefrom.

There is shown in FIG. 6 representative patterns obtained from normal sewing operation, and the corresponding lateral patterns obtained by applying the bight information to the feed actuator. Thus in FIG. **6*a*, there is shown a normal zig zag pattern when the sewing machine is operated in forward feed, and the needle 22 undergoes lateral excursions from one extreme position to the opposite extreme position and return. In FIG. 6*b*, there is shown the lateral pattern obtained when the bight information is applied to the feed actuator 65, and the needle bar 21 and sewing needle 22** are swung in response to the output from the arm shaft position sensor 42. Thus, the work material is fed laterally to the left or right in response to the selected L or R position of the needle feed button 33, and the feed actuator 65 is positioned in response to the selected L or R position of the needle feed button 33, and the feed actuator 65 is positioned in response to the plus or minus bight position signals which control, however, forward or reverse feed. The result is a lateral zig zag pattern very much similar to the longitudinal pattern shown in FIG. 6*a*. Where shifting of the needle bar 21 and of the sewing needle 22 while in the work material generates some motion of the work material in the longitudinal direction, a suitable adjustment to the balance control knob 37 may be made which will permit true lateral feeding. The balance control knob 37 adjusts the feed balance potentiometer 71 shown in FIG. 2 which is also utilized in FIG. 5 but not shown for the sake of simplicity. In FIG. 6*c*, there is shown a pattern obtainable in the normal sewing mode which runs in the longitudinal direction. If the pattern selector button 31 were selected to give the pattern shown in FIG. 6*c*, and the needle feed button 33 were placed in the R position, the lateral pattern shown in FIG. 6*d* results. In this event, the sewing needle 22 is caused to move rightwardly while in a work material under the influence of a signal from the arm shaft position sensor 42. The feed actuator 65 is responsive to the bight digital information from the LSI memory and logic chip 44 to cause forward and reverse feeding as shown. If, on the other hand, the needle feed button 33 is placed in the L position, the pattern shown in FIG. 6*e* ensues. In this event, the sewing needle 22 undergoes movement to the left, while in a work material, in response to a signal derived from the arm shaft position sensor 42; while the feed signal is derived in the same fashion as explained above. In FIG. 6*f*, there is shown another longitudinal pattern obtainable in the normal sewing mode by selection of the proper selector button 31. In FIG. 6*g*, there is shown the lateral pattern which would ensure if the same selector button 31 were depressed, and the needle feed button 33 were placed in either the L or R position. Since this pattern is symmetrical, the selection of the L or R position of the needle feed button 33 will result in the same lateral pattern, although the work material will be fed in different directions. As explained with regard to pattern 6*b*, the patterns 6*d*, *e*, and *g* may require adjustment to obtain true lateral feeding by manipulation of the balance control knob 37 in order to avoid a pattern having a resultant forward or rearward component of feed. It will be appreciated that those patterns obtainable in normal sewing with normal longitudinal feed, in which successive needle penetration are on opposite sides of the center line will give the most uniform lateral feed patterns having the closest similarity to the normal longitudinal pattern. In order to obtain a lateral feed pattern, ideally a forward feed motion must be countered by a reverse motion of equal dimension, preferably, although not necessarily, in succession.

FIG. 6*h* refers to a normal longitudinal straight stitch, and FIG. 6*i* a straight stitch in lateral right or left direction. Alternate lateral and longitudinal straight stitches may be used when sewing on a patch, for example, and the use of the easy feed attachment 163 may facilitate stitching in both the lateral and longitudinal direction.

Thus has been disclosed an electronically controlled family sewing machine which may be simply adapted for lateral stitching and patterning in addition to the heretofor known capabilities for longitudinal stitching and patterning. With the disclosure herein contained, it will be readily apparent to those skilled in the art that the provision of a LSI memory and logic chip 44 especially prepared to provide the lateral patterning information as well as the longitudinal patterning capability currently available, taken together with certain of the switching arrangements herein suggested, will also result in a sewing machine having capability to feed a work material laterally as well as longitudinally. What has been disclosed herein is the present best economical mode contemplated for readily obtaining such a sewing machine.

Having thus set forth the nature of the invention, what is sought to be claimed is:

1. In a sewing machine having stitch forming instrumentalities positionally controlled over a predetermined range between stitches to produce a pattern of feed and of bight controlled stitches, said instrumentalities including a needle carrying bar supported for lateral jogging movement and for endwise reciprocation alternately to move a needle carried thereby into and out of engagement with a work material being sewn; electronic means for storing pattern information; signal means operating in timed relation with the sewing machine for recovering selected pattern stitch information from said electronic storing means; and feed actuating circuit means including an actuator and bight actuating circuit means including an actuator responsive to said selected feed and bight pattern stitch information, respectively, for positioning said stitch forming instrumentalities to produce a pattern of stitches corresponding to the selected pattern stitch information; wherein the improvement comprises:

means for selectively inhibiting the utilization of said selected pattern stitch information by said actuators, means for generating special pattern stitch information, and means for initiating application of said special pattern stitch information to said actuator of said bight actuating circuit means including said actuator while said needle is in engagement with said work material and in place of said selected pattern stitch information.

2. In a sewing machine as claimed in claim 1 wherein said special pattern stitch information generated by said generating means includes needle return information, and wherein said initiating means initiates application of said needle return information to said actuator of said bight actuating circuit means while said needle is out of engagement with said work material.

3. In a sewing machine as claimed in claim 2 wherein said signal means has two stable output states, the first starting after said needle moves into engagement with said work material and the second starting when said needle moves out of engagement therewith, and wherein said generating means is implemented by said stable output states of said signal means.

4. In a sewing machine as claimed in claim 3 further comprising an inverting means for reversing said output states of said signal means, means for inserting said inverting means between said signal means and said electronic storing means, and means for connecting said electronic storing means to said feed actuating circuit means, whereby said actuator of said feed actuating circuit means moves in response to said selected pattern stitch information normally utilized by said bight actuating circuit means while said actuator of said bight actuating circuit means moves in response to said stable output states of said signal means.

5. In a sewing machine as claimed in claim 4 wherein said two stable output states of said signal means are of opposite polarity and wherein said bight actuating circuit means includes an operational amplifier having inverting and non-inverting input terminals, said improvement further comprising means for selectively connecting said signal means to a selected input terminal of said operational amplifier, whereby said actuator of said bight actuating circuit means moves in a selected direction while said needle is in engagement with said work material.

6. In a sewing machine having stitch forming instrumentalities positionally controlled over a predetermined range between stitches to produce a pattern of feed and of bight controlled stitches, said instrumentalities including a needle carrying bar supported for lateral jogging movement and for endwise reciprocation alternately to move a needle carried thereby into and out of engagement with a work material being sewn, said instrumentalities further including means for feeding work material in a longitudinal direction; a presser system means for urging work material against said feeding means; electronic means for storing pattern information; signal means operating in timed relation with the sewing machine for recovering selected pattern switch information from said electronic storing means, said signal means having a first stable output state after said needle moves into engagement with a work material and a second stable output state after said needle moves out of engagement therewith; and feed actuating circuit means including an actuator and bight actuating circuit means including an actuator responsive to said selected feed and bight pattern stitch information, respectively, for positioning said stitch forming instrumentalities to produce a pattern of stitches corresponding to the selected pattern stitch information; wherein the improvement comprises:

means for selectively inhibiting the utilization of said selected pattern stitch information by said actuators, means for generating special pattern stitch information, and means for initiating application of said special pattern stitch information to said actuator of said bight actuating circuit means for movement of said actuator in one direction while said needle is in engagement with said work material and for movement thereof in a return direction while said needle is out of engagement with said work material and in place of said selected pattern stitch information.

7. In a sewing machine as claimed in claim 6 wherein said presser system means of said sewing machine includes an attachment device having a presser foot yieldably urged against said work material, said attachment device pivotably carrying an upper feeding foot movable in a direction substantially normal to said lateral jogging movement of said needle carrying bar, said attachment device further carrying a lever connected to said needle carrying bar for imparting oscillatory motion thereto, and means connecting said lever with said upper feeding foot for urging said upper foot into engagement with said work material at least during ingress and egress of said work material by said needle, whereby said work material obtains a measure of support during penetration and withdrawal from the work material of the sewing needle.

8. In a sewing machine as claimed in claim 7 wherein said operating means is implemented by said stable output states of said signal means.

9. In a sewing machine as claimed in claim 8 further comprising an inverting means for reversing said output states of said signal means, means for inserting said inverting means between said signal means and said electronic storing means, and means for connecting said electronic storing means to said feed actuating circuit means, whereby said actuator of said feed actuating circuit means moves in response to said selected pattern stitch information normally utilized by said bight actuating circuit means while said actuator of said bight actuating circuit means moves in response to said stable output states of said signal means.

10. In a sewing machine as claimed in claim 9 wherein said bight actuating circuit means includes an operational amplifier having inverting and non-inverting input terminals, said improvement further comprising means for selectively connecting said signal means to a selected input terminal of said operational amplifier, whereby said actuator of said bight actuating circuit means moves in a selected direction while said needle is in engagement with said work material.

* * * * *

UNITED STATES PATENT OFFICE

CERTIFICATE OF CORRECTION

PATENT NO. : 4,123,981

DATED : November 7, 1978

INVENTOR(S) : Jack Brown

It is certified that error appears in the above-identified patent and that said Letters Patent are hereby corrected as shown below:

Column 6, line 39, after "stitch, insert -- length --

Column 11, line 39, delete "ensure" and insert -- ensue --

Column 13, Claim 6, line 25, delete "switch" and insert -- stitch --

Column 14, Claim 8, line 22, delete "operating" and insert -- generating --

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*